US005332226A

United States Patent [19]

Kim

[11] Patent Number: 5,332,226

[45] Date of Patent: Jul. 26, 1994

[54] GOLF BALL

[75] Inventor: Chun-Sik Kim, Kwangju, Rep. of Korea

[73] Assignee: Kumho & Co, Inc., Seoul, Rep. of Korea

[21] Appl. No.: 990,258

[22] Filed: Dec. 14, 1992

[30] Foreign Application Priority Data

Apr. 21, 1992 [KR] Rep. of Korea ..... 6705/1992

[51] Int. Cl.[5] ..... A63B 37/14

[52] U.S. Cl. ..... 273/232

[58] Field of Search ..... 273/232

[56] References Cited

U.S. PATENT DOCUMENTS

| | | | |
|---|---|---|---|
| 4,141,559 | 2/1979 | Melvin et al. | 273/232 X |
| 4,560,168 | 12/1985 | Aoyama | 273/232 |
| 4,729,861 | 3/1988 | Lynch et al. | 273/232 X |
| 4,744,564 | 5/1988 | Yamada | 273/232 |
| 4,772,026 | 9/1988 | Gobush | 273/232 |
| 4,830,378 | 5/1989 | Aoyama | 273/232 |
| 4,948,143 | 8/1990 | Aoyama | 273/232 |
| 4,979,747 | 12/1990 | Jonkouski | 273/232 |
| 5,087,049 | 2/1992 | Yamagishi et al. | 273/232 |

*Primary Examiner*—George J. Marlo

*Attorney, Agent, or Firm*—Watson, Cole, Grindle & Watson

[57] ABSTRACT

A golf ball has a spherical body having a mold parting line at the equator thereof by which the body is divided into a top half sphere and a bottom half sphere of equal dimensions, the molded partition line having no dimples thereon; an axis passing through the center of the plane which is defined by the mold parting line, the axis defining two poles at the intersection thereof with each of the half spheres, and being perpendicular to the plane; a first set of four identical spherical regular triangles and six identical spherical right triangles distributed over the surface of the top half-sphere, and serving as a constraining pattern for dimple distribution; a second set of four identical spherical regular triangles and six identical spherical right triangles distributed over the surface of the bottom half sphere and serving as a constraining pattern for dimple distribution, said second set of spherical triangles being a mirror image of the first set of spherical triangles but rotated by 60 degrees centering around said axis; and a series of dimples whose configuration being determined so as to fit in said constraining patterns, at least one of said configurations being determined to exhibit optimum performance with a tailwind, one being determined to exhibit optimum performance into a headwind, one being determined to exhibit optimum performance under no wind and other configurations being determined to exhibit optimum performance under low altitude, high altitude, low temperature, and high temperature conditions, respectively.

5 Claims, 4 Drawing Sheets

GOLF BALL

BACKGROUND OF THE INVENTION

1. Field of the Invention

This invention relates to golf balls, and, more particularly to a golf ball which has dimples which are so placed on the surface of the ball so as to maximize the performance of the golf ball when played under the wide variety of environmental and atmospheric conditions encountered in the game of golf.

2. Description of the Prior Art

For many years the manufacturers of golf balls have attempted to maximize the distance achieved when a golf ball is struck by a golf club and more specifically when the golf ball is struck by the number 1 wood or driving club. Many patents have been granted on inventions which improve the aerodynamic performance or distance of the golf ball. The use of multiple dimple sizes, depths and shapes and the avoidance of multiple parallel rows of dimples has substantially improved the distance achieved by golf balls.

The location of the dimples on the spherical surface of the golf ball entails dividing the spherical surface of the sphere into smaller areas and locating the dimples according to the resultant constraining pattern. The platonian figures of the octahedron, dodecahedron and icosahedron have been widely used, usually being further subdivided in smaller areas so as to minimize the distortional effect of planar to spherical conversion. In addition to the platonian figures a number of geometric prism and other geodesic shapes have been used to develop dimple constraining patterns.

Many patents have been granted on improved golf balls which employ particular patterns or spatial relationships to achieve the improved performance. U.S. Pat. No. 4,141,559 relates to the use of an icosahedron as a constraining pattern in order to eliminate multiple parallel rows of dimples and circumferential paths around the surface of the ball which are not intersected by dimples. U.S. Pat. No. 4,729,861 again deals with the use of an icosahedron as a constraining pattern but specifies the spatial relationship between dimples.

While the use of these patterns improved the distance performance of the prior art ball of Taylor's U.S. Pat. No. 878,254 it was subsequently discovered that these products would not pass the USGA rule regarding symmetrical flight of the golf ball which requires that a golf ball perform the same aerodynamically when hit on the equator and spun about an axis through the equator.

As a result of this failure of the symmetry rule many new patterns and patents resulted. The most popular development was the use of multiple parting lines or dimple free great circles on the surface of the ball. U.S. Pat. Nos. 4,147,727, 4,560,168 and 4,948,143 are examples of this art. While these patterns resulted in improving the aerodynamic symmetry of the ball, the smooth bands or circumferential paths which are not intersected by dimples resulted in higher aerodynamic drag and hence shorter distance as pointed out in U.S. Pat. No. 4,141,559.

U.S. Pat. No. 4,744,564 represented a distinct departure in the means of achieving aerodynamic symmetry. By shallowing the depths and hence reducing the volume of the dimples in the polar region of the ball, the ball could be made to fly in a symmetrical manner without having a significant impact on distance. Heretofore, all golf balls had all dimples of the same size on the ball the same depth. If the ball had multiple dimple sizes, each dimple of the same size would be the same depth over the entire surface of the sphere. Further, it was well known to those skilled in the art that increasing the dimple depth on a golf ball made it fly lower while decreasing the dimple depth raised the trajectory, so it was anticipated that shallowing the dimple depths on a portion of the ball would cause the ball to fly higher. This was not the case with the ball of U.S. Pat. No. 4,744,564 however as the trajectory in the poles horizontal mode remained relatively unchanged and the trajectory in the pole over pole orientation actually decreased to match the poles horizontal mode.

Using the new dimple patterns and conventional wisdom many new products were introduced which were improvements over the prior art. Specialized products such as low trajectory balls and high trajectory balls were introduced which performed better into the wind and with a tailwind respectively. Designs such as this allowed a player to change golf balls to suit conditions and thus improve the distance achieved on a given hole and gain an advantage on the player who did not change golf balls to suit the conditions on the hole. In order to eliminate this unfair advantage the USGA established the one ball rule which requires the player to use the same type of ball for the entire round of eighteen holes of tournament play. This has led manufacturers of golf balls to direct their research efforts toward development of a golf ball which exhibits optimum performance under the broad range of conditions under which the game of golf is played.

Before describing the current invention in detail it may be useful to list some of the considerations or empirical guidelines in understanding a golf ball design and how a golf ball can be made to fly lower or higher at the designer's discretion. These could be summed up as follows;

(A) For a golf ball of a given construction, deeper dimples will cause the ball to fly lower, and shallower dimples will cause the ball to fly higher.

(B) Large, shallow dimples will cause the ball to fly higher than small, deep dimples even though the large, shallow dimples have greater volume than the smaller, deeper dimples.

(C) Circumferential pathways around the surface of the ball, whether they be great circles or parallels, which are not intersected by dimples and are hence smooth, create additional drag and retard the distance of the ball. FIG. 1 is a good pictorial example of this problem. Many lines can be drawn around the ball without intersecting dimples. Some of these lines are great circles or "equators" and the other lines are concentric with these great circles and hence are parallels.

(D) At high altitudes the density of the air and its kinematic viscosity is less.

This is directly related to aerodynamic performance and teaches us that a golf ball which performs well at sea level may not perform well at high altitudes.

Conversely a golf ball which is designed to perform well for high altitude play my not perform well at sea level.

(E) Cold temperatures increase the density of the air as well as its kinematic viscosity, thus affecting the aerodynamic performance of the ball.

(F) Using a variety of dimple sizes on the ball has a positive effect on distance if the depth of these dimples is optimized.

Generally speaking the aerodynamic performance of a flying object such as a golf ball is dynamic and depends on the environmental condition, and there are many other facts which could be stated in regard to golf ball development.

SUMMARY OF THE INVENTION

The invention provides for a method of optimizing the performance of a golf ball under a wide variety of the conditions under which the game of golf is played. By designing certain areas of the ball to have a high trajectory, certain areas a low trajectory and certain areas an intermediate trajectory and by further utilizing a variety of dimple sizes and depths for achieving maximum distance a golf ball has been produced which exhibits improved aerodynamic performance regardless of whether it is played under a headwind, tailwind, no wind, high altitude, low altitude, high temperature, low temperature or any combination of these conditions.

DETAILED DESCRIPTION OF THE INVENTION

Figure 1:
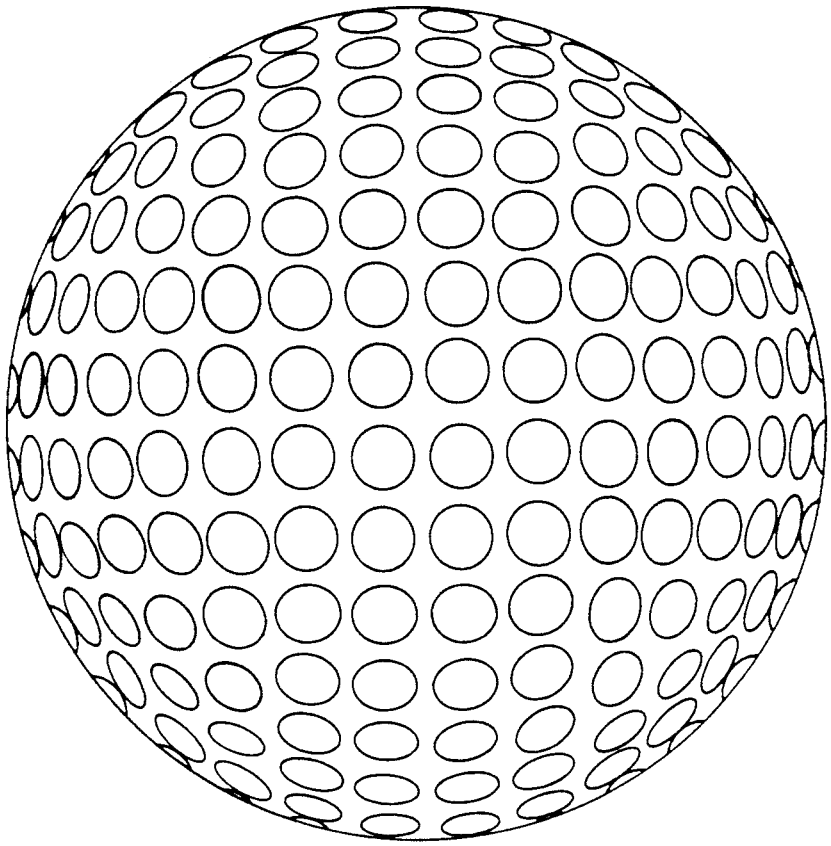
FIG. 1 PRIOR ART
FIG. 1 is a drawing of a prior art golf ball which was in use from 1908 until the present.
Figure 2:
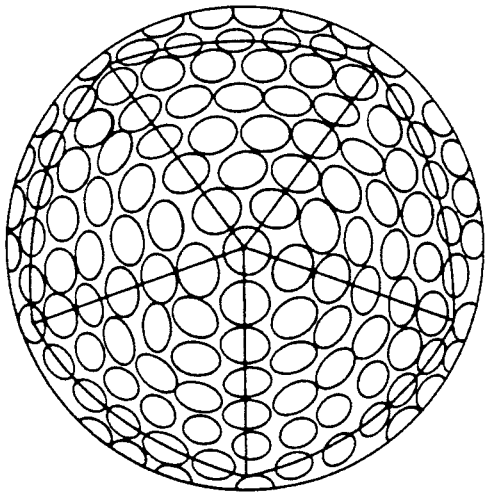
FIG. 2 PRIOR ART
FIG. 2 is a drawing of a golf ball disclosed in U.S. Pat. No. 4,729,861 which represents an improvement over the prior art ball of FIG. 1.
Figure 3:
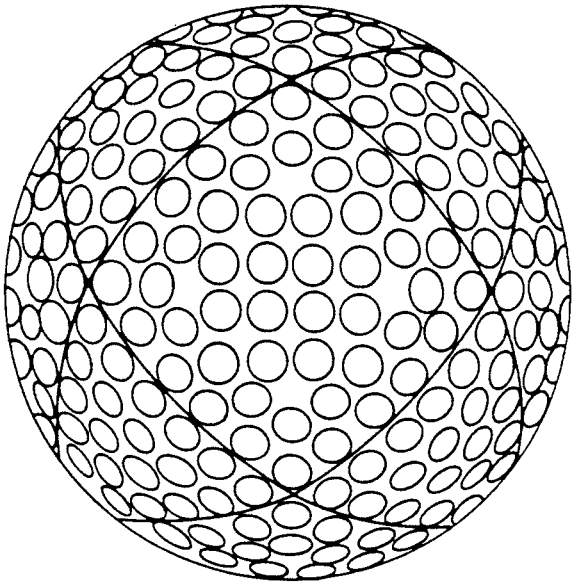
FIG. 3 PRIOR ART
FIG. 3 and FIG. 4 are drawings of prior art golf balls using multiple dimple free great circles to achieve aerodynamic symmetry.
Figure 4:
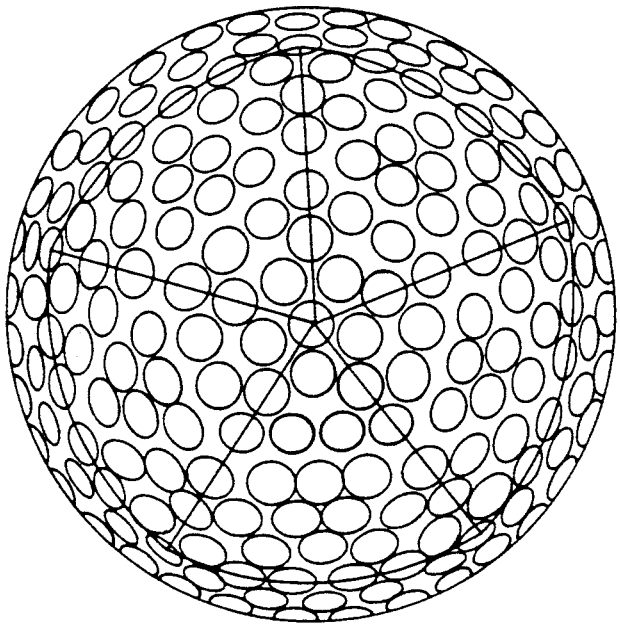
FIG. 4 PRIOR ART
Figure 5:
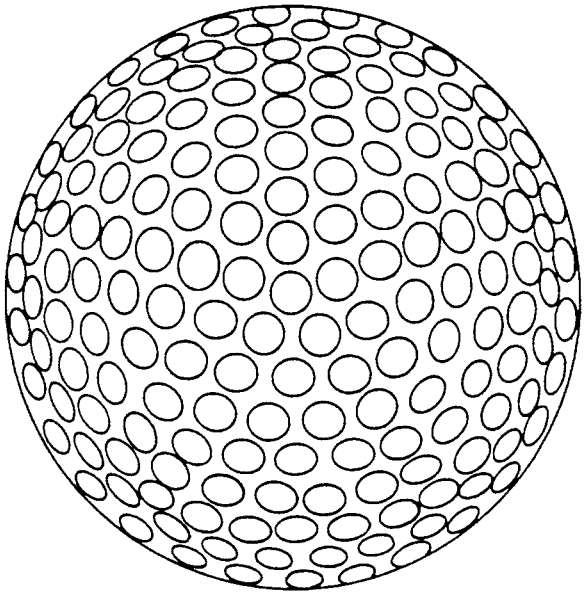
FIG.5 PRIOR ART
FIG. 5 is a drawing of a golf ball showing how aerodynamic symmetry can be achieved by reducing the dimple depths and hence volume in the polar region of the ball. This golf ball is disclosed in U.S. Pat. No. 4,744,564.

It is well known to those skilled in the art that the arrangement, size, depth and shape of the dimples on a golf ball determine the trajectory, distance, and, to some extent, the dispersion of the golf ball. It is further revealed in U.S. Pat. No. 4,744,564 that by varying the volume of the dimples in the polar regions of the ball, the aerodynamic symmetry of the ball can be adjusted.

In the current invention a golf ball is produced which has its surface first divided into a series of spherical polygons. A series of dimple configurations is then determined which will fit in the constraining pattern. One configuration is determined which exhibits optimum performance with a tailwind, one configuration is determined which exhibits optimum performance into a headwind, other configurations are determined which exhibit optimum performance under no wind, low altitude, high altitude, low temperature and high temperature conditions. It should be noted that the volume of the dimples on the ball will generally be slightly different for each of the different conditions which are being optimized.

Once the above determinations have been made, a golf ball is constructed which utilizes characteristics of each of the various optimizations. A small portion of the ball will have dimples which are best for tailwind, a small portion best for headwind, and small portions which are best for no wind, low altitude, high altitude, low temperature and high temperature. Each of these areas are such that they fit in the spherical polygons which form the constraining pattern of the ball and are localized. This is analogous to taking each of the configurations optimizations described above and cutting it along its constraining pattern thus creating a jigsaw puzzle and putting together in a new configuration utilizing parts of each of the puzzles.

Each of these small areas contribute to the overall aerodynamics of the golf ball. That is, the changes in dimple sizes and depths in a small or localized area on the spherical surface of the golf ball have an overall or global effect on the golf ball. What is surprising is that when the ball is constructed with many small areas which are optimized for performance under specific conditions which we want to cope with, the net result is a synergistic effect from the sum of the contributions of the individual areas and the resulting golf ball exhibits excellent performance superior to conventional golf balls over a broader range of playing conditions. This has led to the creation of the terminology "Localized Aerodynamic Phenomenon".

Although somewhat empirical by nature, as previously stated, there are certain guidelines which are followed in the restructuring of the golf ball from the optimized components. Since the majority of golf playing occurs at relatively low elevations, under relatively low winds, a larger percentage of the ball should be covered with components designed for optimization under these conditions. Further the total volume of the dimples which is the sum of the volumes of the optimized components should be in the range which is optimal for playing under calm conditions at low elevations. This has been analytically determined to be in the range of 0.02 to 0.026 cubic inches if the volume is measured from a chord across the top of the dimple.

REPRESENTATIVE EMBODIMENT

Figure 6:
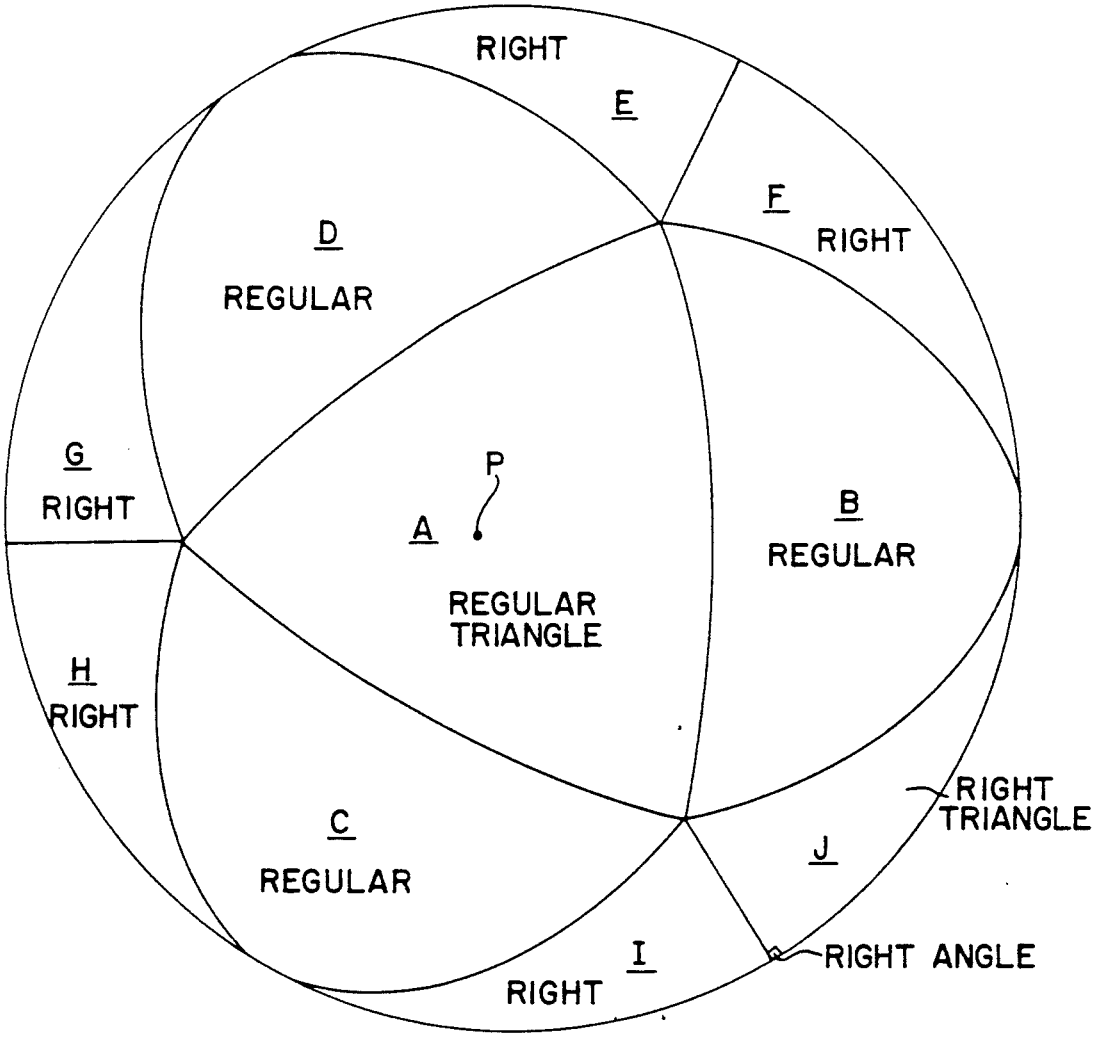
FIG. 6 is a drawing of a polar view of a golf ball dimple constraining pattern which is a geodesic prism consisting of 8 identical spherical regular triangles and 12 identical spherical right triangles.

FIG. 6 depicts a polar view of a spherical surface which has been divided into 8 identical spherical regular triangles (only four of these; A, B, C, and D, are visible) and 12 identical spherical right triangles(only six of these; E, F, G, H, I, and J, are visible). Each of the spherical regular triangles is identical in size and shape and each of the spherical right triangles is identical in size and shape. However, the location, size, number and depth of the dimples contained within these constraining triangles are not uniformly the same over the entire surface of the ball and in fact must be different in order to meet the desired performance criteria of this invention.

The best results which we have achieved thus far have been achieved by utilizing the design criteria shown in Table 1 attached in the end of this description. As expected the majority of the surface of the ball is covered with areas which produce a normal trajectory with no wind at moderate temperatures and low altitude (25.72 percent of the surface) or normal trajectory with no wind at high temperatures and low altitude (16.18 percent of the surface). However, since the transition from low aerodynamic drag to high aerodynamic drag in the flight of a golf hall is a function of both the velocity of the ball and the viscosity of the air, regions of the ball had to be designed to cover essentially all of the conditions under which the golf ball might be played.

Figure 7:
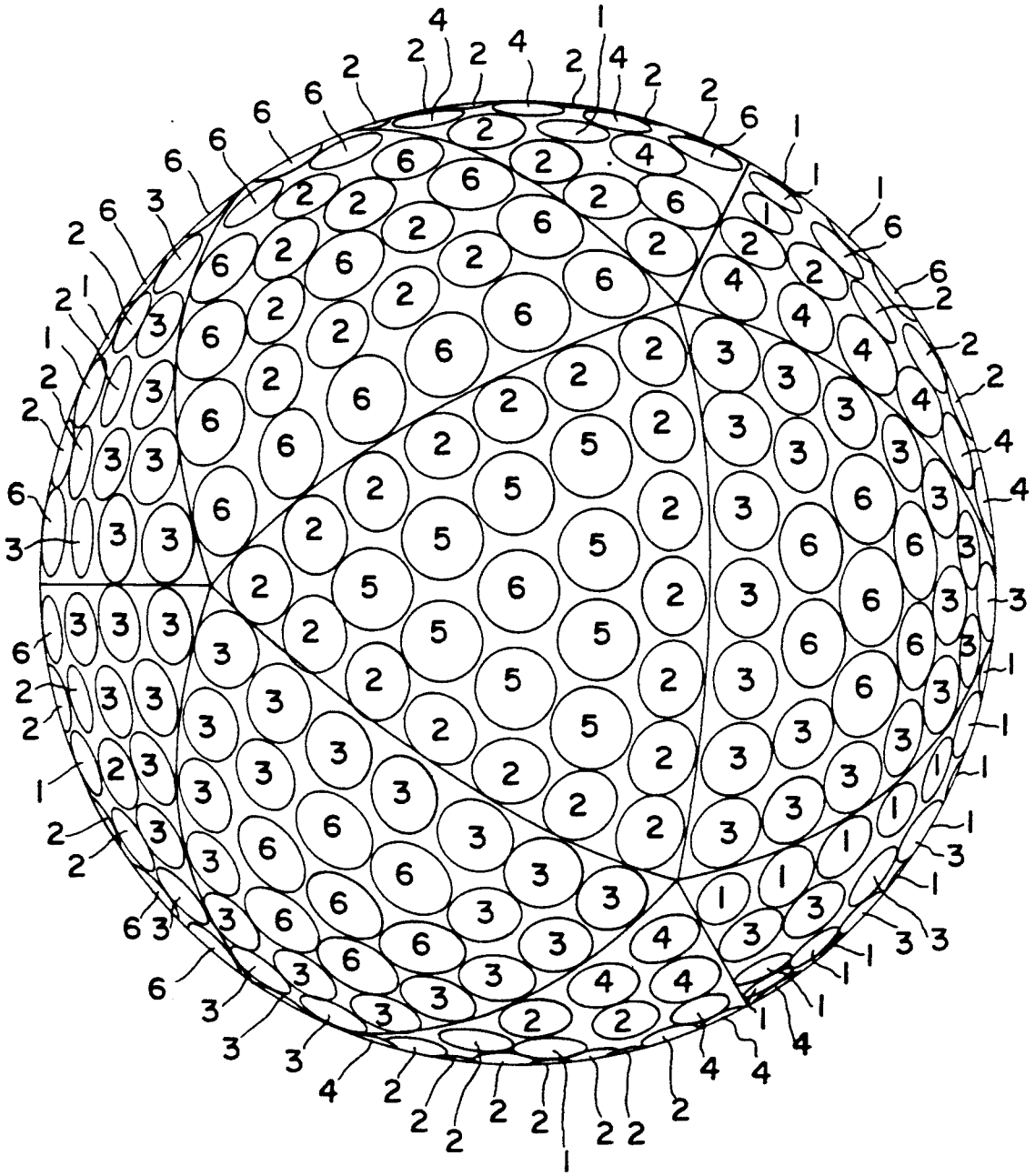
FIG. 7 is a drawing of a representative golf ball of the current invention showing the dimples contained in the dimple constraining pattern of FIG. 6.

Numerous design iterations led to the development of the golf hall shown in FIG. 7. The golf ball of FIG. 7 shows the constraining pattern of FIG. 6 but has the dimples located inside the costraining pattern. The golf ball has six different dimple sizes which are identified as numbers 1 through 6. The size and quantity of the dimples are identified in Table 2 also attached in the end of the description. Examination of FIG. 7 will show that it corresponds to the design criteria established in Table 1, where regular spherical triangles B and C are identical in dimple layout and right spherical triangles G and H are indentical in dimple layout. The remainder of all the triangles are different in dimple layout and are designed for optimization of specific conditions and to contribute to the localized aerodynamic phenomenon.

It should be noted that the bottom half of the golf ball of FIG. 7 is essentially a mirror image of the top half of the ball which is shown, but is rotated by an amount which produces the most aesthetically pleasing seam line or equator. The proper amount of rotation of the bottom half of the ball with respect to the top half of the ball is 60 degrees and this could have been 180 degrees or 300 degrees. The fact that the bottom half of the ball represents a mirror image of the top half is accounted for in Table 1, where the percentage of coverage of the spheres for the various triangles actually represents coverage for two of these triangles.

Numerous performance tests have been conducted on the product of the design of FIG. 7, and in each test, regardless of playing or environmental condition, the golf ball equalled or exceeded all of the competitive golf balls in aerodynamic performance.

While only one golf ball design is revealed in FIGS. 6 and 7, it should be understood and is considered to be a part of this invention, for numerous designs of golf balls with different constraining patterns and different numbers of dimples could be developed using this principle of localized aerodynamic phenomenon and the "jigsaw puzzle" approach to optimizing the performance of the golf ball. The only requirement is that the constraining pattern must divide the surface of the sphere into enough smaller areas to allow for optimization. For a half sphere it is felt that this number should be a minimum of eight and hence sixteen for the entire sphere.

TABLE 1

| | DESIGN CRITERIA | | | | | |
|---|---|---|---|---|---|---|
| TRIANGLE | TYPE | TRAJECTORY | WIND | ALTITUDE | TEMPERATURE | PERCENT OF SURFACE OF SPHERE |
| A | ISOSCELES | HIGH | TAIL | LOW | MODERATE | 12.86 |
| B | " | NORMAL | NONE | " | " | 12.86 |
| C | " | " | NONE | " | " | 12.86 |
| D | " | LOW | HEAD | " | " | 12.86 |
| E | RIGHT | HIGH | TAIL | " | HIGH | 8.09 |
| F | " | HIGH | TAIL | HIGH | MODERATE | 8.09 |
| G | " | NORMAL | NONE | LOW | HIGH | 8.09 |
| H | " | NORMAL | NONE | " | " | 8.09 |
| I | " | LOW | HEAD | HIGH | LOW | 8.09 |
| J | " | LOW | HEAD | LOW | " | 8.09 |

TABLE 2

| No. | DIMPLE DIA | QTY |
|---|---|---|
| 1 | .125 | 44 |

TABLE 2-continued

| No. | DIMPLE DIA | QTY |
|---|---|---|
| 2 | .135 | 124 |
| 3 | .140 | 126 |
| 4 | .145 | 34 |
| 5 | .150 | 18 |
| 6 | .155 | 82 |

What is claimed is:

1. A golf ball comprising:

a spherical body having a mold parting line at the equator thereof by which said body is divided into a top half sphere and a bottom half sphere of equal dimensions, said molded partition line having no dimples thereon;

an axis passing through the center of the plane which is defined by said mold parting line, said axis defining two poles at the intersection thereof with each of aid half spheres, and being perpendicular to the plane;

a first set of four identical spherical regular triangles and six identical spherical right triangles distributed over the surface of the top half-sphere, and serving as a constraining pattern for dimple distribution;

a second set of four identical spherical regular triangles and six identical spherical right triangles distributed over the surface of the bottom half sphere and serving as a constraining pattern for dimple distribution, said second set of spherical triangles being a mirror image of the first set of spherical triangles but rotated by 60 degrees centering around said axis; and a series of dimples whose configuration being determined so as to fit in said constraining patterns, at least one of said configurations being determined to exhibit optimum performance with a tailwind, one being determined to exhibit optimum performance into a headwind, one being determined to exhibit optimum performance under no wind and other configurations being determined to exhibit optimum performance under low altitude, high altitude, low temperature, and high temperature conditions, respectively.

2. The gold ball as defined in claim 1 wherein, for each half sphere, one spherical regular triangles is so centrally located that the center thereof lies at the pole and the remaining three spherical regular triangles are located around said one regular triangle in such a way that each remaining spherical regular triangle shares a different side of the three sides of the triangle (A), and the six spherical right triangles are so located as to have the hypotenuses thereof in common with the side of said three remaining triangles, respectively.

3. The golf ball as defined in claim 2 wherein the arrangement of spherical polygons and distribution of dimples are as depicted in FIG. 7, and wherein the size and quantity of the dimples are as follows:

| No. | DIMPLE DIA | QTY |
|---|---|---|
| 1 | .125 | 44 |
| 2 | .135 | 124 |
| 3 | .140 | 126 |

-continued

| No. | DIMPLE DIA | QTY |
|---|---|---|
| 4 | .145 | 34 |
| 5 | .150 | 18 |
| 6 | .155 | 82 |

4. The golf ball as defined in claim 3 wherein the volumes of the dimples on the ball are slightly different for each of the different conditions which are being optimized, but the total volume of the dimples is in the range of 0.02 to 0.026 cubic inches if the volume is measured from a chord across the top of the dimple.

5. The golf ball as defined in claim 1 the total number of dimples distributed on the surface of the ball is 428.

* * * * *